US008042474B2

(12) United States Patent
Perakis

(10) Patent No.: US 8,042,474 B2
(45) Date of Patent: Oct. 25, 2011

(54) DEVICE FOR SUSPENDING AND MOVING AN OBJECT OR PERSON

(76) Inventor: Philippe Perakis, Leysin (CH)

( * ) Notice: Subject to any disclaimer, the term of this patent is extended or adjusted under 35 U.S.C. 154(b) by 51 days.

(21) Appl. No.: 12/595,458

(22) PCT Filed: Apr. 11, 2008

(86) PCT No.: PCT/EP2008/054420

§ 371 (c)(1),
(2), (4) Date: Oct. 9, 2009

(87) PCT Pub. No.: WO2008/125626

PCT Pub. Date: Oct. 23, 2008

(65) Prior Publication Data

US 2010/0107919 A1 May 6, 2010

(30) Foreign Application Priority Data

Apr. 13, 2007 (EP) ..... 07106093

(51) Int. Cl.
*B61B 7/00* (2006.01)

(52) U.S. Cl. ..... 104/112; 104/113; 104/93; 104/173.1

(58) Field of Classification Search ..... 104/27, 104/28, 29, 30, 178, 179, 173.1, 184, 187, 104/112, 113
See application file for complete search history.

(56) References Cited

U.S. PATENT DOCUMENTS 4,523,525 A * 6/1985 Foster ..... 104/173.2
4,545,575 A * 10/1985 Forjot ..... 482/69
5,660,113 A * 8/1997 Lehotsky ..... 104/113
6,360,669 B1 * 3/2002 Albrich ..... 104/93
6,427,601 B2 * 8/2002 Albrich ..... 104/87
6,550,392 B2 * 4/2003 Albrich ..... 104/89
7,004,077 B2 * 2/2006 Meindl ..... 104/173.1
7,559,281 B2 * 7/2009 Huard et al. ..... 104/173.1
7,685,947 B2 * 3/2010 Moritzhuber ..... 104/180
7,699,140 B2 * 4/2010 Beggrow et al. ..... 182/36
7,806,055 B2 * 10/2010 Michel ..... 104/173.1
2002/0124763 A1 * 9/2002 Albrich ..... 104/112

(Continued)

FOREIGN PATENT DOCUMENTS

DE 76 581 8/1894

(Continued)

OTHER PUBLICATIONS

International Search Report issued in International Application No. PCT/EP2008/054420, mailed Oct. 24, 2008.

(Continued)

*Primary Examiner* — Joe Morano, IV
*Assistant Examiner* — Jason C Smith
(74) *Attorney, Agent, or Firm* — DLA Piper LLP US

(57) ABSTRACT

The present invention concerns a device for the suspension and displacement of an object or a person, this device including at least two unaligned cables, a profile borne by the cables and a trolley mobile over the length of this profile, characterized in that the profile links said cables together, in that the profile located between the two unaligned cables defines a curved zone, in that the profile includes at least one rectilinear zone in which the cable is kept in the profile and in that the cable is located outside of the profile in the curved zone and close to this curved zone. This device can be used as a Tyrolean traverse.

10 Claims, 5 Drawing Sheets

U.S. PATENT DOCUMENTS

| | | | | |
|---|---|---|---|---|
| 2005/0081738 | A1* | 4/2005 | Meindl | 104/173.1 |
| 2008/0229967 | A1* | 9/2008 | Lins et al. | 104/173.1 |
| 2010/0107919 | A1* | 5/2010 | Perakis | 104/112 |

FOREIGN PATENT DOCUMENTS

| | | |
|---|---|---|
| EP | 1 026 061 | 8/2000 |
| EP | 1 238 880 | 9/2002 |
| WO | WO 2005/023617 | 3/2005 |

OTHER PUBLICATIONS

English translation of International Search Report issued in International Application No. PCT/EP2008/054420, mailed Oct. 24, 2008.

Written Opinion issued in International Application No. PCT/EP2008/054420, mailed Oct. 24, 2008.

* cited by examiner

DEVICE FOR SUSPENDING AND MOVING AN OBJECT OR PERSON

TECHNICAL FIELD

The present invention concerns a device for the suspension and displacement in particular of an object or a person, this device being notably intended to be used as an aerial rope slide.

BACKGROUND ART

Currently, various suspension devices exist, enabling the displacement of an object or a person from one point to another by means of a cable or a rope. With these devices, either the cable is driven and the object to be moved is integral with the cable, or the cable is stationary and the object is mobile on the cable. The present invention concerns the second variant.

Among the existing devices using this variant, devices known under the name of aerial rope slide, "taggle rope" or "zip lines" exist, that are made from two anchor points linked by a cable or rope along which the object or person moves. These anchor points can be at different altitudes so that gravity moves the person or object from the highest point to the lowest point.

In these devices, the person's or object's path is rectilinear since the rope or cable is tight between the two anchor points. To be more specific, it should be specified that the rope or cable presents sag and that the term rectilinear should be understood as "contained in a vertical plane".

Given that the cable is fixed only to each of its ends, it is not possible to make very long sections, for example, several kilometers.

Other devices are also available that enable displacing suspended people or objects in which the path may include turns, that is, the path is not contained in only one vertical plane. In these devices, a metallic structure is generally used, such as a rigid rail to which the object or person to be moved is suspended and this object or person follows the rail route. This type of device presents two major drawbacks. On the one hand, it implies the set-up of a heavy structure which has a harmful impact on the environment in which it is placed. On the other hand, the cost of such an installation is relatively high.

Such a device is notably described in the patent application EP1 238 880. In the embodiment described in this document, the system comprises a rail formed of sections linked together at each end. This rail is suspended to cables supported by pylons. In this invention, the rail must be rigid because it must bear important stress, particularly on the turns. The result is also the setting up of a heavy and expensive structure which cannot be placed in some environments such as, for example, in the mountains.

Other similar devices are described, for instance, in documents EP 1 026 061 or DE 76581. These documents nevertheless do not deal satisfactorily with the management of the turns.

The present invention proposes overcoming the drawbacks of the devices of the prior art by realizing a suspension device allowing the displacement of objects or people, this device enabling realizing sections of any length, involving rectilinear zones as well as curved zones, not needing, nevertheless, an unaesthetic and expensive heavy structure.

DISCLOSURE OF INVENTION

The object of the invention is obtained by a device for the suspension and displacement of an object or a person, this device including at least two unaligned cables, a profile borne by the cables and a trolley mobile over the length of this profile, characterized in that the profile links said cables together, in that the profile located between the two unaligned cables defines a curved zone, in that the profile includes at least one rectilinear zone in which the cable is kept in the profile and in that the cable is located outside of the profile in the curved zone and close to this curved zone.

According to this invention, the suspension device may form any path made up of rectilinear and curved zones, having any length. For this, this device is formed from a plurality of cables or portions of cable, each fixed with two anchor points, two consecutive cables being linked between them by profiles that may form curved and turning zones. The rolling trolley moves along the profiles in a way that allows smooth movement for the object or the person. This device can thus be used as an aerial rope slide, allowing any course whatsoever, for all that the topography of the place in which the device is installed allows movement by gravity.

The invention's device associates the features of the cables, namely their capacity to support an object in a vertical plane, with features of the profiles, namely allowing guidance according to any path, depending upon the form of the profile.

According to this invention, the way of linking the profiles and the cables allows for smooth displacement, which represents an important feature for the comfort of the user. This also represents an important feature for the safety and reliability of the device. Indeed, a zone in which a jolt occurs is a weakening zone and has the potential risk of breaking. The manner of linking the cables and the profiles in the invention makes it possible to not be immune to problems of different dilatation between the profiles and the cables.

BRIEF DESCRIPTION OF DRAWINGS

The present invention and its advantages will be better understood with reference to the enclosed figures and the detailed description of a specific embodiment, in which.

MODES FOR CARRYING OUT THE INVENTION

Figure 1:
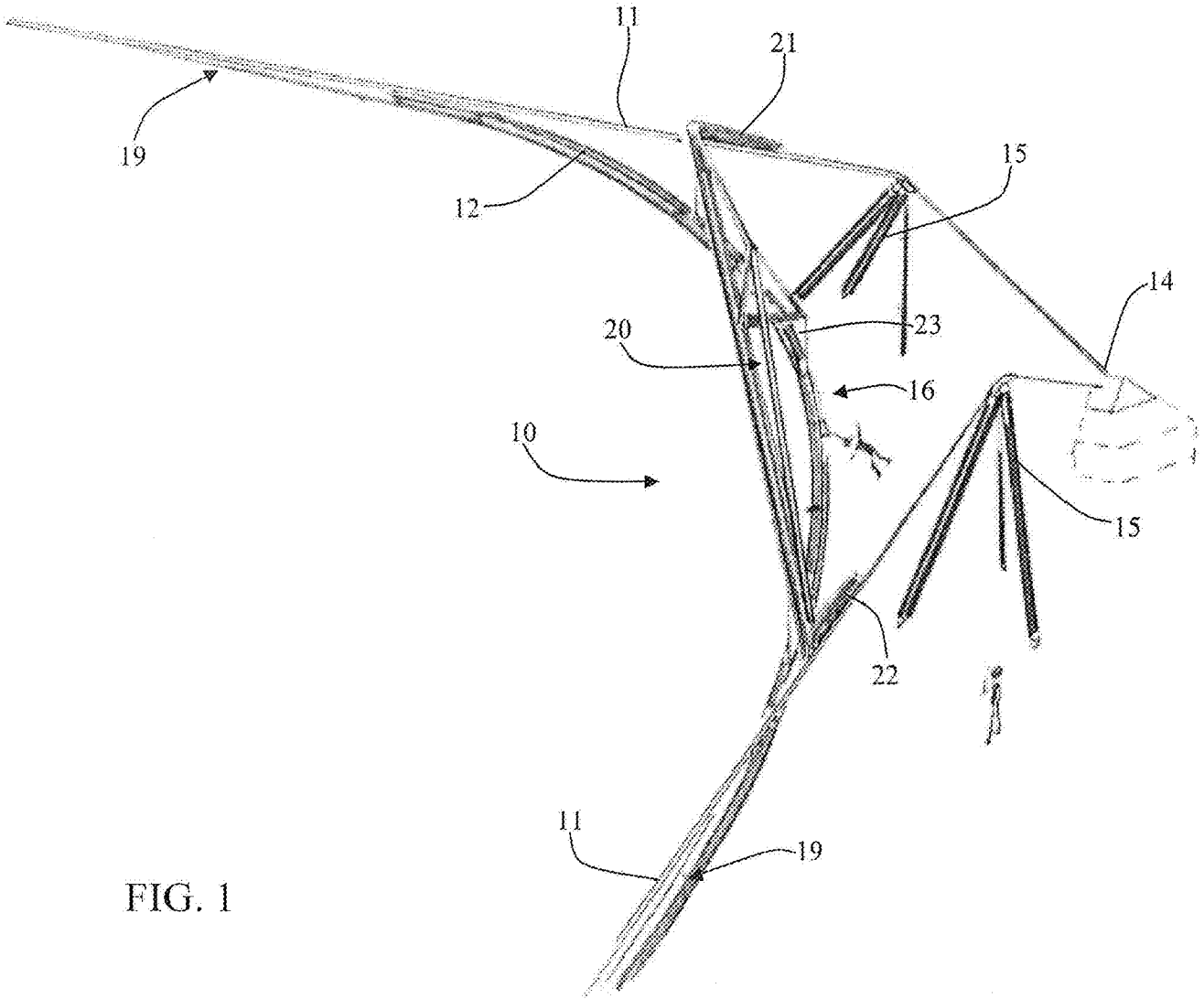
FIG. 1 is a general view of the device of the present invention.

In reference to these figures, the device 10 for the suspension and displacement according to the present invention is formed, notably of cables 11, profiles 12 and a trolley 13 which moves along the cables and profiles.

The invention is described below in an example of embodiment in which the suspension and displacement device is formed of two cables 11 linked together by a curved profile 12. In practice, the invention is generally made of several cables, two consecutive cables being linked by a curved profile. The number of cables is unlimited.

In the form of execution represented, the invention's device comprises at least three anchor points 14, denoted here as upper anchor point, lower anchor point and intermediate anchor point. A portion of cable 11 or a cable is placed between two consecutive anchor points, so as to be tightened between these points. The intermediate anchor point can be used to maintain both the cable fixed to the upper anchor point and that fixed to the lower anchor point. It is also possible to foresee two independent intermediate anchor points, that is, an anchor point intended to keep the cable upstream and another anchor point relatively close, intended to keep the cable downstream.

Given that the cables are intended to receive people or objects that are suspended on them, it is clear that the cable must be placed in such a manner that the person or object do not touch the ground when moving along the cable. In order to guarantee a sufficient height, it is foreseen that the cable will be placed on a pylon 15. This pylon can serve as an anchor point. It is nevertheless, preferable that the anchor is made as close as possible to the ground. Thus, a pylon is generally foreseen to ensure that the cable is kept at a sufficient height and a massive anchor is fixed to the ground. Clearly, the configuration also depends on the terrain in which the invention's device is installed. An anchor without a pylon can also be considered, for example, on two rock faces, as long as the configuration of the terrain allows it.

The cables being bent between the anchor points, they form roughly rectilinear sections. In the invention, two consecutive cables are separated by a curved zone 16 or a turning zone. This curved zone is described in detail below.

Figure 2:
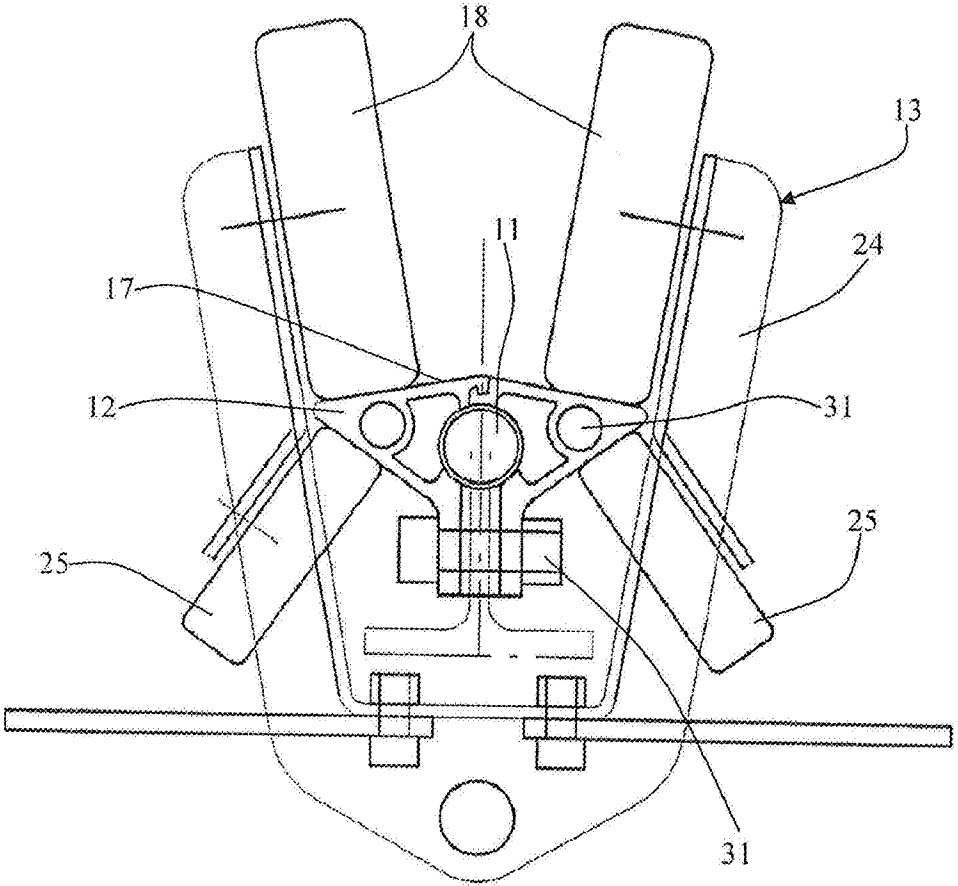
FIG. 2 is a section view of the invention's device in a zone in which the cable is contained in the profile.

According to a preferred embodiment, the bearing cable is held, practically for its entire length, in the profile 12. This profile is such that, on the rectilinear part of the cable, it almost completely surrounds the cable and presents two upper faces 17. These faces allow the support of displacement elements such as wheels 18 of the trolley 13. FIG. 2 illustrates the profile 12 surrounding the cable 11 in a rectilinear portion of this cable. According to the embodiment illustrated by FIG. 2, a transversal cross section of the upper faces 17 of the profile is roughly plane. According to variants, these faces could present a concave or convex cross section among this. In this case, the displacement element generally has a complementary form in order to ensure keeping the displacement element in position on the profile.

According to an advantageous embodiment, the profile can be realized in two practically symmetrical parts that may be made integral. Such a profile could be made by extrusion, in aluminum or in a plastic material, for example.

Figure 3:
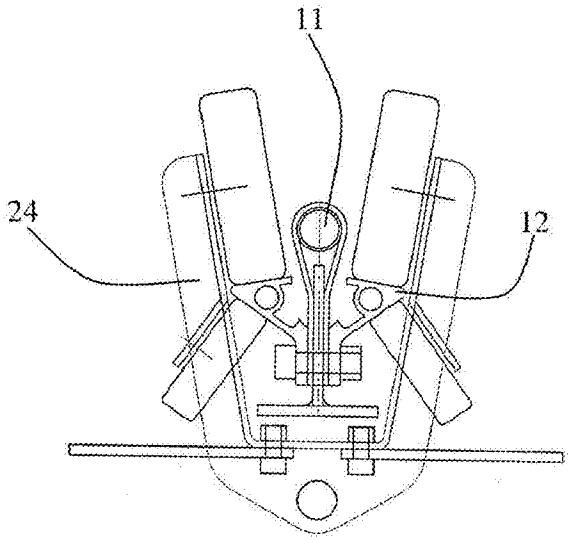
FIG. 3 represents the invention's device, in a position in which the cable is partially on the exterior of the profile.
Figure 5:
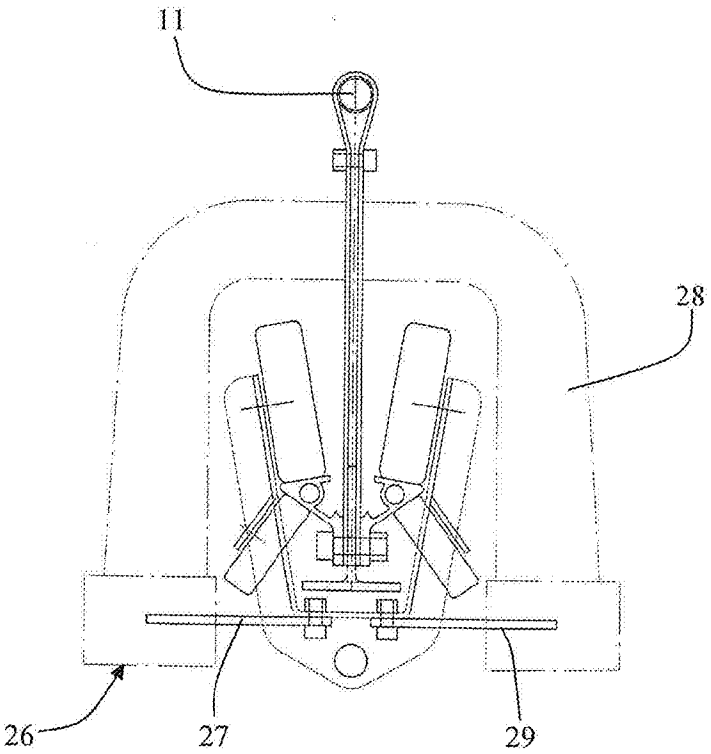
FIG. 5 illustrates a detail of the device according to the invention.
Figure 4:
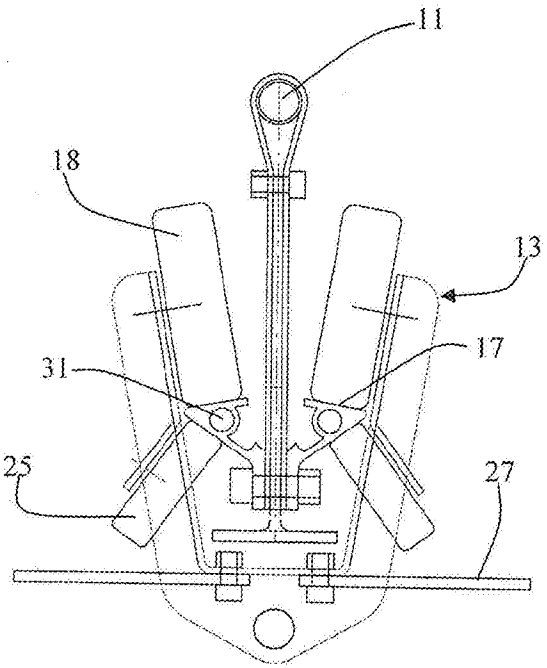
FIG. 4 is a view similar to FIG. 3, in a position in which the cable is completely on the exterior of the profile.
Figure 7:
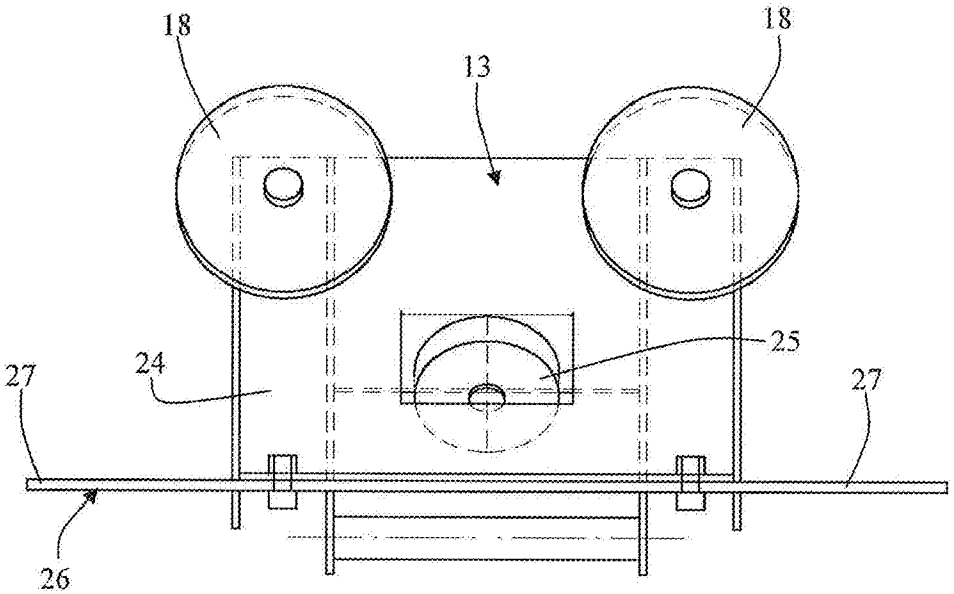
FIG. 7 is a profile view of the invention's trolley.

The device of the invention includes a zone, called transition zone 19, that can be defined by the end of the cable's rectilinear zone and a profile's rectilinear zone. In this transition zone, the profile 12 remains rectilinear and is kept in a vertical plane containing the cable. Nevertheless, the profile and the cable are separate so that the cable is no longer completely contained in the profile. This is illustrated in particular by FIGS. 3 to 5. To do this, the upper part of the profile 12 is cut off, so that the cable 11 can come out of the profile which is progressively lowered under the cable. In the beginning of the transition zone, the cable is found in the envelope defined by trolley 13. The more one advances along the length of the profile, the more the distance between the cable 11 and the profile 12 increases, and this, until the cable is completely released from the profile and the trolley. The profile then forms the curved zone 16 or the turning zone.

In this curved zone, the profile is no longer in contact with the cable. It is held thanks to a portal frame 20 that can rest on the cable. This portal frame is formed from a framework that supports the profile in the curved zone 16 and that can be simply fixed to the cables or according to a variant, placed on pylons. In the example illustrated by FIG. 1, the portal frame 20 is fixed to the cables. The portal frame comprises an arm 21 rigidly fixed to one of the cables. It also comprises another arm 22 that allows it to be fixed to an adjacent cable. This second fixation is preferably not rigid, but authorizes a light rotation or a movement of the portal frame in relation to the second cable, which allows limiting the mechanical stress between the cables and the portal frame and allows an independent movement of these elements. This allows, in particular, compensation for the different dilatations between the cable and the profile, as well as a lengthening of the cable due to its ageing. This portal frame further comprises suspension elements 23, realized for example under the form of metallic or synthetic cable sling that carry the profile 12 in the curved zone 16.

The curved zone of the profile is extended by a rectilinear transition zone 19 that progressively rises towards the cable until it is completely contained in the profile.

The trolley 13 comprises suspension means for an object or a person and is used to "hang" the object or the person to be displaced. In the case of a person, he or she may be seated in a harness or in a seat for example. The trolley is formed notably from a frame 24 supporting the displacement elements 18. In the embodiment illustrated, the ensemble comprises four upper wheels 18 and two lower wheels 25. The four upper wheels have the function of allowing the trolley to be displaced along the profile 12. The two lower wheels are supported on a lower guiding surface of the profile and ensure that the trolley stays in the correct position in relation to the profile. They act as guidance means. It is clear that it is possible to foresee a different number of wheels. Other devices could also be used to allow the displacement of the trolley along the profile, for example a needle bearing or bearing pads presenting weak friction with the profile. Similarly, the lower wheels 25 could be replaced by other equivalent means such as a bearing pad, in particular.

According to an advantageous embodiment, the trolley 13 includes, in cooperation with the profile, braking means 26. These braking means can advantageously function according to the principle of the eddy current brake. For that purpose, the trolley includes two metallic elements such as blades 27 stretching toward the outside of the frame. A part of the profile, in particular the transition zone 19, comprises a magnet 28 that may be a permanent magnet or an electromagnet, endowed with slots 29 for the passage of the blades of the trolley. When this trolley, and more specifically its blades, comes close to the magnets of the transition zone at a given speed, the displacement of these blades generates a force that opposes to this displacement. Thus, a decrease in speed results, which allows a person to travel over the curved zone 16 at a sufficiently low speed to not be subjected to a too great centrifugal acceleration. The decrease in speed can be chosen, in particular by regulating the length of the zone including the magnets and the distance between the magnets and the blades.

It is possible to invert the elements of the braking means 26, that is, to place one or several magnets on the frame of the trolley and to place metallic blades on the profile or close to it.

Figure 6:
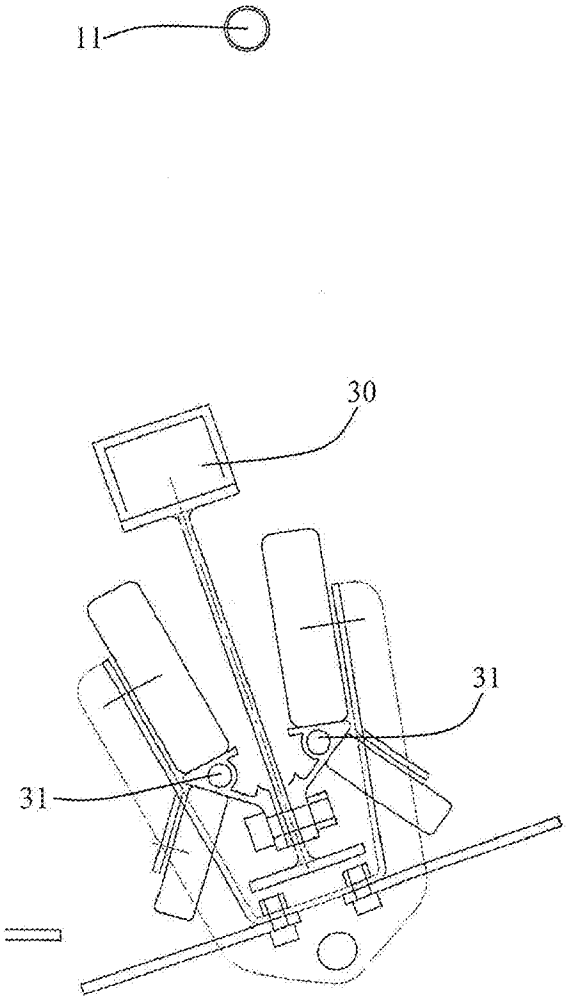
FIG. 6 illustrates the position of the trolley of the invention when the trolley is in a curved zone.
Figure 8:
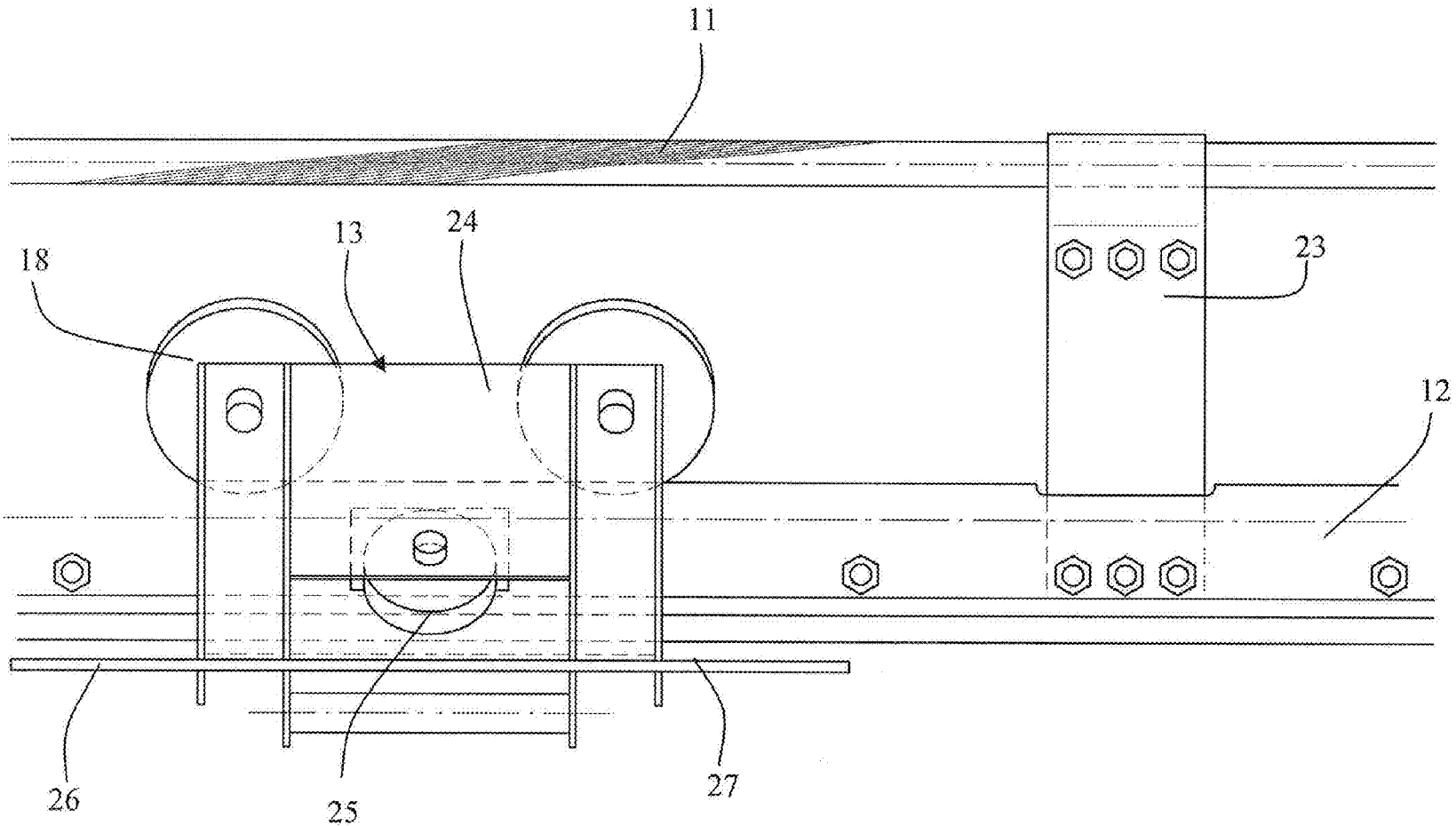
FIG. 8 is a profile view similar to the view of FIG. 4.

Under the action of the centrifugal force, the person or object moving along the curved zone of the profile will be inclined toward the exterior of the curve. In order not to deform the profile 12, this is, on the one hand, inclined and, on the other hand, linked to a rigid rail 30 illustrated in particular by FIG. 6. This rigid rail is integral with the profile in the curved zone or at least in a part of it and is fixed to the portal frame 20 by suspension elements 23.

According to an advantageous embodiment, the profile 12 is formed of sections that can be assembled, end to end at the time of their installation. For this purpose, the ends of the sections may include a hollow 31 in which a connector stud (not represented) is fixed. This stud allows ensuring the alignment of the sections and, consequently, a smooth passage for the trolley from one section to another. The lower part of the profile may also comprise an anchor clip 31 to which an attachment plate may be fixed, for instance, by screws. This enables ensuring that two consecutive sections of the profiles remain integral with each other.

In the curved zones having a rail 30, given that this rail is integral with the profile 12, it is advantageous to provide the rail with eyelet openings in which the profile passes. In this manner, the profile is closed at regular intervals, even in the zone comprising the rail, which guarantees a better solidity for the ensemble.

According to a variant, the trolley 13 may include an energy dissipater element (not represented). This may, for example, be formed from a non-aerodynamic part placed on the frame 24. This element has the function of limiting the maximum speed that the trolley can reach. It is also possible to foresee air brakes for which the control can be activated either automatically when the speed of the trolley reaches a certain threshold, or by the user. Other types of brakes, for example, an emergency brake activated automatically or by the user can be foreseen. These brakes can be mounted on the fixed part, i.e., the profile, the cable or a pylon, or on the mobile part, in particular the trolley. It is also possible to foresee means allowing managing several trolleys using the same installation simultaneously. For this purpose, braking means can in particular be taken on board of the trolley. These braking means can be activated according to the result of position measures for the trolleys. These measures can be performed, for example, by a GPS, a passage detector placed on a pylon or along the profile or by any other similar method. Thanks to these means, it is in particular possible, to avoid two trolleys coming too close together, which may create a risk of collision between the users.

The invention has been described above under the form of an example including two cables 11, i.e., two rectilinear zones connected together by a curved zone 16. It is clear that it is possible to realize a circuit comprising a far greater number of rectilinear and curved zones. The positions of the anchor points may be chosen according to the configuration of the terrain in which they are installed. Consequently, it is possible to use almost any terrain.

The equipment of a terrain with the invention's device only needs little infrastructure. Indeed, only the anchor zones must be permanently set-up. The pylons 15 can be realized in the form of a relatively light and removable structure. The cables and the portal frames are also removable.

According to a variant, it is possible to foresee an intermediate support in a rectilinear zone. For this, the profile 12 is locally cut to allow a sling 23 to pass similarly to what was done in the curved zone. This opening does not interfere with the passage of the trolley and may be done at any point of the circuit. This has the advantage of making it possible to support the cable by places, thus avoiding too much sag or very great cable tension. In this way, it is possible to ensure that the slope of the cable is always in the same direction, whatever the location of the trolley may be. This avoids, in particular for foreseeing, a motor on the trolley, in order to make it go up the slope in case of an emergency stop. The requirement to have a motor added to the trolley makes it heavy which accentuates all the more the local inversion phenomenon of the slope.

The curved or turning zones may form all sorts of circuits, in particular arcs of a circle, curves in the form of an S or even one or several complete circle or spiral turns.

The present invention thus allows the realization of aerial rope slides having a particularly great cable length and forming a circuit made up of rectilinear and curved zones without rigid structure. This also allows adapting almost any terrain and equipping it without impacting its aesthetic aspect.

The invention claimed is:

1. A device for the suspension and displacement of an object or a person, this device comprising:

at least two unaligned cables;

a profile borne by the cables; and a trolley mobile over the length of the profile;

wherein the profile links said cables together, wherein the profile located between the two unaligned cables defines a curved zone, wherein the profile includes at least one rectilinear zone in which one of the cables is kept in the profile and wherein the cable is located outside of the profile in the curved zone and close to the curved zone.

2. The device according to claim 1, wherein the profile comprises at least one upper support surface organized to hold said trolley.

3. The device according to claim 2, wherein the profile further comprises at least one lower guiding surface.

4. The device according to claim 1, wherein the trolley is always supported on the profile, in the zone in which the cable is contained in the profile and in the zone in which the cable is located outside the profile.

5. The device according to claim 1, wherein the part of the profile that links two unaligned cables is suspended from a portal frame.

6. The device according to claim 5, wherein the portal frame is supported by the cables.

7. The device according to claim 5, wherein the portal frame is rigidly fixed to one of the cables and not rigidly fixed to the other cable.

8. The device according to claim 1, wherein the device includes a plurality of cables, each cable being linked to the next by a profile, in a way to form an uninterrupted circuit from the first cable to the last cable.

9. The device according to claim 1, wherein the trolley includes a frame supplied with at least two displacement elements configured to allow the displacement of the trolley along the profile.

10. The device according to claim 1, further comprising braking means.

* * * * *